US005480756A

United States Patent [19]

Mahabadi et al.

[11] Patent Number: 5,480,756

[45] Date of Patent: Jan. 2, 1996

[54] HIGH GLOSS, LOW MELT CROSSLINKED RESINS AND TONERS

[75] Inventors: Hadi K. Mahabadi; Enno E. Agur, both of Toronto; T. Brian McAneney, Burlington; Sheau V. Kao; Gerald R. Allison, both of Oakville; Michael S. Hawkins, Cambridge, all of Canada; William H. Hollenbaugh, Jr., Webster, N.Y.; Robert M. Jacobs, Ontario, N.Y.; Che C. Chow, Penfield, N.Y.

[73] Assignee: Xerox Corporation, Stamford, Conn.

[21] Appl. No.: 334,012

[22] Filed: Oct. 31, 1994

[51] Int. Cl.[6] ..... G03G 9/087

[52] U.S. Cl. ..... 430/109; 430/110

[58] Field of Search ..... 430/106, 109, 430/110

[56] References Cited

U.S. PATENT DOCUMENTS

| | | | |
|---|---|---|---|
| 3,590,000 | 6/1971 | Palermiti et al. | 252/62.1 |
| 3,681,106 | 8/1972 | Burns et al. | 117/17.5 |
| 4,513,074 | 4/1985 | Nash et al. | 430/106.6 |
| 4,533,614 | 8/1985 | Fukumoto et al. | 430/99 |
| 4,797,339 | 1/1989 | Maruyama et al. | 430/99 |
| 4,973,439 | 11/1990 | Chang et al. | 264/101 |
| 5,057,392 | 10/1991 | McCabe et al. | 430/109 |
| 5,227,460 | 7/1993 | Mahabadi et al. | 528/272 |
| 5,395,723 | 3/1995 | Mahabadi et al. | 430/137 |
| 5,401,602 | 3/1995 | Mahabadi et al. | 430/137 |
| 5,414,052 | 5/1995 | Mahabadi et al. | 430/31 |

*Primary Examiner*—John Goodrow
*Attorney, Agent, or Firm*—E. O. Palazzo

[57] ABSTRACT

A low melt, high gloss toner resin with low minimum fix temperature, wide fusing latitude and wide gloss latitude contains a linear portion and 1 to 10 percent by weight of a crosslinked portion containing high density, crosslinked microgel particles, but substantially free of low density, crosslinked polymer. The resin is particularly suitable for high gloss applications, such as process color and color transparencies, and for high speed fusing, shows excellent offset resistance, wide fusing latitude, wide gloss latitude and superior vinyl offset properties. The resin may be formed by reactive melt mixing.

40 Claims, 3 Drawing Sheets

HIGH GLOSS, LOW MELT CROSSLINKED RESINS AND TONERS

BACKGROUND OF THE INVENTION

The present invention is generally directed to toner resins, toners thereof, and to processes for the preparation thereof. More specifically, the present invention relates to partially crosslinked resins that can be selected for the preparation of high gloss heat fixable toners with, for example, excellent low temperature fixing characteristics and superior gloss and offset properties in a hot roll fixing system, and with excellent vinyl offset properties and wherein in embodiments the fuser roll life can be increased.

A need exists for high gloss toners which melt at lower temperatures than a number of toners now used with certain copying and printing machines. Temperatures of approximately 160° to 200° C. are often selected to fix a toner to a support medium, such as a sheet of paper or transparency, to create a developed image. These high temperatures may reduce or minimize the life of certain fuser rolls such as those comprised of silicone rubbers or fluoroelastomers like VITON®, may limit fixing speeds, and may necessitate larger amounts of power to be consumed during operation of a copier or printer, such as a xerographic copier which employs a method of fixing such as, for example, hot roll fixing.

Toner utilized in the electrographic process is generally prepared by mixing and dispersing a colorant and a charge enhancing additive into a thermoplastic binder resin, followed by micropulverization. As the thermoplastic binder resin, several polymers are known including polystyrenes, styrene-acrylic resins, styrene-methacrylic resins, polyesters, epoxy resins, acrylics, urethanes and copolymers thereof. As the colorant, carbon black or other color pigment is utilized often, and as the charge enhancing additive, alkyl pyridinium halides, distearyl dimethyl ammonium methyl sulfate, and the like are known.

To fix the toner to a support medium, such as a sheet of paper or transparency, hot roll fixing is commonly used. In this method, the support medium carrying a toner image is transported between a heated fuser roll and a pressure roll, with the image face contacting the fuser roll. Upon contact with the heated fuser roll, the toner melts and adheres to the support medium, forming a fixed image. This fixing system is very advantageous in heat transfer efficiency and is especially suited for high speed electrophotographic processes.

Fixing performance of the toner can be characterized as a function of temperature. The lowest temperature at which the toner adheres to the support medium is referred to as the Cold Offset Temperature (COT), and the maximum temperature at which the toner does not adhere to the fuser roll is referred to as the Hot Offset Temperature (HOT). When the fuser temperature exceeds HOT, some of the molten toner adheres to the fuser roll during fixing and is transferred to subsequent substrates containing developed images, resulting for example in blurred images. This undesirable phenomenon is known as offsetting. Between the COT and HOT of the toner is the Minimum Fix Temperature (MFT) which is the minimum temperature at which acceptable adhesion of the toner to the support medium occurs, as determined by, for example, a creasing test. The difference between MFT and HOT is referred to as the Fusing Latitude.

Gloss performance of toner can be characterized as a function of fusing temperature as shown in FIG. 1. The fusing temperature at which the image attains a gloss level of 50 gloss units is referred to as the Gloss 50 Temperature, $T(G_{50})$; hereinafter, all gloss units refer to TAPPI T480 75° specular gloss unless otherwise indicated. The difference between $T(G_{50})$ and HOT is referred to as the Gloss Latitude. The maximum gloss level of the image in the temperature range between MFT and HOT is referred to as Peak Gloss.

Many prior art toner resins developed have the required melt viscosity to produce images with high gloss on plain paper, for example from about 25 to about 60 gloss units, with reference to a high gloss toner resin. Toners which generate high gloss images are often selected for process color applications and transparencies. Although these properties are desired, the fixing or fusing temperature of toners prepared from these resins are high and usually more than 160° C. This may result in high power consumption, low fixing speeds, and reduced life of the fuser roll and fuser roll bearings. Offsetting can also be a problem. Furthermore, toners containing vinyl type binder resins, such as styrene-acrylic resins, may have an additional problem which is known as vinyl offset. Vinyl offset occurs when a sheet of paper or transparency with a fixed toner image comes in contact for a period of time with a polyvinyl chloride (PVC) surface containing a plasticizer used in making the vinyl material flexible such as, for example, in vinyl binder covers, and the fixed image adheres to the PVC surface. Also, a number of toner resins having lower melt temperatures have a narrow fusing latitude and have poor mechanical properties, creating too many fines during jetting which have to be removed by classification and reused. This results in increased cost of the toner.

There is a need for a high gloss toner resin and toner thereof, which has a fix temperature below 200° C., preferably below 160° C. (referred to as low fix temperature toner resin or low melt toner resin), excellent offset performance, wide gloss latitude, and superior vinyl offset properties, and processes for the preparation of such a resin. Toners which operate at lower temperatures would reduce the power needed for operation and increase the life of the fuser roll and the high temperature fuser roll bearings. Additionally, such low melt toner resins would reduce the volatilization of release oil, such as silicon oil, which may occur during high temperature operation and which can cause problems when the volatilized oil condenses in other areas of the machine. In particular, high gloss toners with a wide fusing and excellent gloss latitude and with good toner particle elasticity are needed. Further, toners with wide fusing and excellent gloss latitude can provide flexibility in the amount of oil needed as release agent, can minimize copy quality deterioration related to the toner offsetting to the fuser roll and can extend fuser roll life. These and other advantages are achievable with the toners and processes of the present invention.

To lower the minimum fix temperature of the binder resin, in some instances the molecular weight of the resin may be lowered. Low molecular weight amorphous polyester resins and epoxy resins have been used for low temperature fixing toners. For example, attempts to use polyester resins as a binder for toner are disclosed in U.S. Pat. Nos. 3,590,000 and 3,681,106. The minimum fixing temperature of polyester binder resins can be lower than that of other materials, such as styrene-acrylic and styrene-methacrylic resins. However, this may lead to a lowering of the hot offset temperature, and as a result, decreased offset resistance and shortened fuser roll life. In addition, the glass transition temperature of the resin may be decreased, which may cause the undesirable phenomenon of blocking of the toner during storage. Furthermore, toner prepared from such a resin will usually generate images with undesirable crease performance and narrow fusing latitude.

U.S. Pat. No. 5,057,392 discloses a low fusing temperature toner powder which employs a polyblend of a crystalline polyester and an amorphous polyester that has been crosslinked with an epoxy novolac resin in the presence of a crosslinking catalyst. The disclosed polyblend contains a mechanical mixture of the crystalline and amorphous polyester melt blended together. The crystalline polyester is required to maintain a desired low melt temperature and the amorphous polyester is required to maintain a desired high offset temperature. In the polyblend, the amorphous polyester is partially crosslinked with the epoxy novolac resin. The disclosed toner powder cannot be achieved in the absence of crystalline and amorphous polyesters, and upon completion of crosslinking, the crystalline polyester recrystallizes as dispersed small particles within a matrix phase of the crosslinked amorphous polyester and epoxy resin. In one disclosed process for preparing the toner particles, the crystalline polyester, amorphous polyester resin, epoxy novolac resin, crosslinking catalyst, colorant, crystallization promoter and optional charge control agent are melt blended, preferably by an extrusion process. During melt blending, the amorphous polyester is crosslinked with the epoxy novolac resin. After melt blending, the mixture is annealed to recrystallize the crystalline polyester. The disclosed melt blended mixture is not useful as a toner particle requiring a low melt temperature until it is annealed. In addition, the glossy image generated on paper with toner prepared from such a mixture does not have a wide fusing latitude.

To prevent fuser roll offsetting and to increase fuser latitude of toners, various modifications have been made to toner compositions. For example, waxes, such as low molecular weight polyethylene, polypropylene, and the like, have been added to toners to increase the release properties as disclosed in U.S. Pat. No. 4,513,074, the disclosure of which is totally incorporated herein by reference. However, to prevent offset sufficiently, considerable amounts of such materials may be required in some instances, resulting in detrimental effects such as the tendency to toner agglomeration, worsening of free flow properties and destabilization of charging properties. Also, waxes tend to degrade projection efficiency of glossy color transparencies.

Modification of binder resin structure, for example, by branching and crosslinking when using conventional polymerization reactions, may also improve offset resistance. In U.S. Pat. No. 3,681,106, for example, a polyester resin was improved with respect to offset resistance by nonlinearly modifying the polymer backbone by mixing a trivalent or more polyol or polyacid with the monomer to generate branching during polycondensation. However, an increase in degree of branching may result in an elevation of the minimum fix temperature. Thus, any initial advantage of low temperature fix may be diminished.

U.S. Pat. No. 4,797,339 discloses a modified toner resin containing a particle-to-particle ionically crosslinked resin complex. The disclosed crosslinked resin complex is obtained by reacting a cationic resin emulsion and an anionic resin emulsion. The resulting resin ion complex has a glass transition temperature of −90° C. to 100° C. and a degree of gellation of from 0.5 to 50 percent by weight, and preferably 10 to 30 percent by weight. It is indicated in this patent that if the degree of gellation is too high beyond 50 percent by weight, the fixability of the toner at low temperatures tends to be reduced undesirably. If it is too low below 0.5 percent by weight, scattering of the toner tends to increase undesirably. The emulsion polymerization process disclosed results in production of a sol component in the polymer, that is crosslinked portions which are not densely crosslinked.

A method of improving offset resistance of high gloss resin is to utilize crosslinked resin in the binder resin. For example, U.S. Pat. No. 3,681,106 discloses a toner in which a crosslinked polyester, prepared using conventional crosslinking methods, is used as the binder resin. Similar disclosures for polyester resins are made in U.S. Pat. Nos. 4,933,252 and 4,804,622.

While significant improvements can be obtained in offset resistance and entanglement resistance in glossy toner resins, a major drawback may ensue in that with crosslinked resins prepared by conventional polymerization, that is crosslinking during polymerization using monomer and a crosslinking agent, there exist three types of polymer configurations: a linear and soluble portion referred to as the linear portion, a portion comprising highly crosslinked gel particles which is not soluble in substantially any solvent, e.g., tetrahydrofuran, toluene and the like, and is the gel, and a crosslinked portion, which is low in crosslinking density and, therefore, is soluble in some solvents, e.g., tetrahydrofuran, toluene and the like, and is the sol. Also, there are monomeric units between the crosslinked polymer chains. The presence of highly crosslinked gel in the binder resin increases the hot offset temperature, but at the same time the low crosslink density portion or sol increases the minimum fix temperature. An increase in the amount of crosslinking in these types of resins results in an increase not only of the gel content, but also of the amount of sol or soluble crosslinked polymer with low degree of crosslinking in the mixture. This results in an elevation of the minimum fix temperature, and as a consequence, in a reduction or reduced increase of the fusing latitude. In addition, a drawback of embodiments of crosslinked polymers prepared by conventional polycondensation in a reactor with low shear mixing, for example less than 0.1 kW-hr/kg, is that as the degree of crosslinking increases, the gel particles or very highly crosslinked insoluble polymer with high molecular weight grow larger. The large gel particles can be more difficult to disperse pigment in, causing the formation of unpigmented toner particles during pulverization, and toner developability may thus be hindered. Also, compatibility with other binder resins may be relatively poor and toners containing vinyl polymers often show vinyl offset.

U.S. Pat. No. 4,533,614 discloses a loosened crosslinked polyester binder resin which shows low temperature fix and good offset resistance. Metal compounds were used as crosslinking agents. Similar disclosures are presented in U.S. Pat. No. 3,681,106 and Japanese Laid-Open Patent Applications 94362/1981, 116041/1981 and 166651/1980. As discussed in the '614 patent, incorporation of metal complexes, however, can influence unfavorably the charging properties of the toner. Also, in the case of color toners other than black (e.g., cyan), metal complexes can adversely affect the color of pigments. It is also known that metal containing toner can have disposal problems in some geographical areas, such as for example in the State of California, U.S.A. Metal complexes are often also expensive materials.

Many processes are known for effecting polymerization reactions, including reactive extrusion processes, for both initial polymerization reactions employing monomers or prepolymers, and for polymer modification reactions, such as graft, coupling, crosslinking and degradation reactions.

U.S. Pat. Nos. 4,894,308 and 4,973,439, for example, disclose extrusion processes for preparing electrophotographic toner compositions in which pigment and charge control additive were dispersed into the binder resin in the extruder. However, in each of these patents, there is no suggestion of a chemical reaction occurring during extrusion.

An injection molding process for producing crosslinked synthetic resin molded articles is disclosed in U.S. Pat. No. 3,876,736 in which polyolefin or polyvinyl chloride resin and crosslinking agent were mixed in an extruder, and then introduced into an externally heated reaction chamber outside the extruder wherein the crosslinking reaction occurred at increased temperature and pressure, and at low or zero shear.

In U.S. Pat. No. 4,089,917, an injection molding and crosslinking process is disclosed in which polyethylene resin and crosslinking agent were mixed in an extruder and reacted in reaction chambers at elevated temperature and pressure. Heating of the resin mixture occurred partially by high shear in inlet flow orifices. However, the crosslinking reaction in this process still took place in the reaction chambers at low or zero shear, and the final product is a thermoset molded part, and thus is not useful for toner resins.

A process for dispensing premixed reactive precursor polymer mixtures through a die for the purposes of reaction injection molding or coating is described in U.S. Pat. No. 4,990,293 in which polyurethane precursor systems were crosslinked in the die and not in the extruder. The dimensions of the die channel were determined such that the value of the wall shear stress was greater than a critical value in order to prevent gel buildup and consequent plugging of the die. The final product is a thermoset molded part, and thus is not useful for toner resins.

The processes disclosed in U.S. Pat. Nos. 3,876,736; 4,089,917 and 4,990,293 are not considered reactive extrusion processes because the crosslinking in each case occurs in a die or a mold, and not in an extruder, and the crosslinking takes place at low or zero shear. These processes are for producing engineering plastics such as thermoset materials which cannot be remelted once molded, and thus are not useful in toner applications.

In U.S. Pat. No. 5,395,723, a polyester toner resin is described, which is prepared by reactive extrusion, and which is suitable for low gloss matte application, such as for example matte black and highlight color application, and which has low fix temperature, excellent offset resistance, wide fusing latitude and shows minimized or substantially no vinyl offset. Also, in U.S. Pat. No. 5,227,460 there are disclosed low melt toners with reactive extruded resins and wherein the microgel particles can be present in an amount of from about 0.001 to about 50 percent, and more specifically, 0.7 weight percent, reference Example I, column 16, and column 7, lines 10 to 15, wherein gel content is recited as about 0.001 to about 50, 0.1 to 40, or 10 to 19. The disclosures of each of the aforementioned documents are totally incorporated herein by reference.

There is a need for high gloss, low melt toner resins and toners thereof with excellent offset resistance, wide fusing and broad gloss latitude, and which resin and toner thereof possess minimized or substantially no vinyl offset, and which toner can be used for process color applications and transparencies. The toner resins involved possess different rheological properties than a resin selected for low gloss applications.

SUMMARY OF THE INVENTION

Extensive research conducted in connection with the present invention has demonstrated that reactive polymers, such as for example unsaturated polyester resins, can be modified by partial crosslinking by reactive extrusion to obtain a wide range of unique properties required for low melt temperature, high gloss toner applications.

Embodiments of the present invention overcome or minimize the above prior art problems of low gloss and high gloss with reduced fuser life. The present invention provides a thermoplastic toner resin which can be sufficiently fixed at low temperatures (e.g., below 200° C., preferably about 100° C. to about 160° C., more preferably about 110° C. to about 140° C.) by hot roll fixing, and which toner resin when formulated into a toner with pigment enables images with a high gloss. Resins according to the present invention can have fusing latitudes of more than or equal to about 60° C., or from about 60° C. to about 100° C., and gloss latitudes of more than or equal to about 40° C., or from about 40° C. to about 100° C. Thus, a fusing temperature of at least 25° C. less than for conventional higher fix temperature toner resins is provided while enabling images with high gloss. Hence, less power is consumed during operation of a copier or printer. The undesirable paper curl phenomenon may also be reduced, and a higher speed of copying and printing may be enabled with the toners of the present invention. Also, toner prepared from the resins of the present invention possess excellent offset resistance, wide fusing and excellent gloss latitude and superior rheological properties for low melt and high gloss applications is inexpensive, safe and economical, shows minimized or substantially no vinyl offset and produces images with high gloss of from about 25 to about 80 gloss units, and preferably from about 25 to about 60 gloss units.

The toner resin of this invention comprises in embodiments crosslinked portions and linear portions with an important gel content of from about 1 to about 10, and preferably 2 to 9 weight percent, and from about 91 to about 98 weight percent of resin. The crosslinked portions comprise very high molecular weight densely crosslinked gel particles having an average diameter less than about 0.1 micron. The crosslinking length between two crosslinked molecules is very short; preferably the crosslinking lengths do not exceed one to two atoms. The crosslinked portions are insoluble in substantially any solvent, including tetrahydrofuran, toluene and the like. The crosslinked portions comprise about 2 percent to about 9 percent percent by weight of the toner resin. The linear portion comprises low molecular weight resin soluble in various solvents, such as for example tetrahydrofuran, toluene and the like. The high molecular weight highly crosslinked gel particles are substantially uniformly distributed in the linear portions. Substantially no portion of the resin comprises sol or low density crosslinked polymer, such as that which would be obtained in conventional crosslinking processes such as polycondensation, bulk, solution, suspension, emulsion and dispersion polymerization processes.

The toner resin of this invention may be fabricated by a reactive melt mixing process to produce low cost crosslinked thermoplastic binder resins for toners which have low fix temperature and high offset temperature, and which show minimized or substantially no vinyl offset and are suitable for toner applications requiring glossy finishes. In this process, polymers are crosslinked in the molten state under high temperature and high shear conditions, preferably using chemical initiators as crosslinking agents without utilizing monomer for crosslinking. Minimized or no residual materials remain in the resin after crosslinking.

In the process of the invention, which is similar to that illustrated in U.S. Pat. No. 5,227,460, the disclosure of which is totally incorporated herein by reference, except with the present invention the gel content is from 2 to 9 weight percent, a reactive resin (hereinafter referred to as base resin), such as, for example, unsaturated linear polyester resin, is crosslinked in the molten state under high temperature and high shear conditions, preferably using a chemical initiator, such as, for example, an organic peroxide, as a crosslinking agent in a batch or continuous melt mixing device without forming any significant amounts of residual materials. Thus, the removal of byproducts or residual unreacted materials is not needed with embodiments of a process of the invention. In preferred embodiments of this process, the base resin and initiator are preblended and fed upstream to a melt mixing device, such as an extruder, at an upstream location, or the base resin and initiator are fed separately to the melt mixing device at either upstream or downstream locations. An extruder screw configuration, length and temperature may be used which enable the initiator to be well dispersed in the polymer melt before the onset of crosslinking, and further which provide a sufficient, but short residence time for the crosslinking reaction to be carried out. Adequate temperature control enables the crosslinking reaction to be carried out in a controlled and reproducible fashion. Gel content of the resin according to the present invention may be controlled by controlling melt temperature and/or amount of chemical initiator. For example, a temperature sufficiently high to achieve crosslinking is maintained in the presence of a chemical initiator. Once the desired amount of crosslinking is obtained, the melt temperature is reduced to terminate the crosslinking reaction. The gel content may also be controlled by the amount of chemical initiator used. Furthermore, the choice of extruder screw configuration and length can also enhance the high shear conditions to distribute microgels formed during the crosslinking reaction throughout the polymer melt, and to keep the microgels from inordinately increasing in size with increasing degree of crosslinking. An optional devolatilization zone may be used to remove any volatiles, if needed. The polymer melt may then be pumped through a die to a pelletizer.

The above process can be utilized to produce a low cost, safe crosslinked toner resin with substantially no unreacted or residual byproducts of crosslinking, and wherein the toner thereof can be sufficiently fixed at low temperature by hot roll fixing to afford energy saving. The toner of the present invention is particularly suitable for high, greater than 75 copies per minute, speed fixing, exhibits excellent offset resistance, and wide fusing and excellent gloss latitude (e.g., low fix temperature, low gloss 50 temperature and high offset temperature), possesses minimized or no vinyl offset and enables a high gloss or glossy finish. This is enabled primarily with the content of the microgel particles in the toner resin of a critical amount of from 2 to 9 weight percent which amounts permit high gloss and extended fuser life for in excess of about 300,000 copies in embodiments.

DETAILED DESCRIPTION OF EMBODIMENTS

Figure 1:
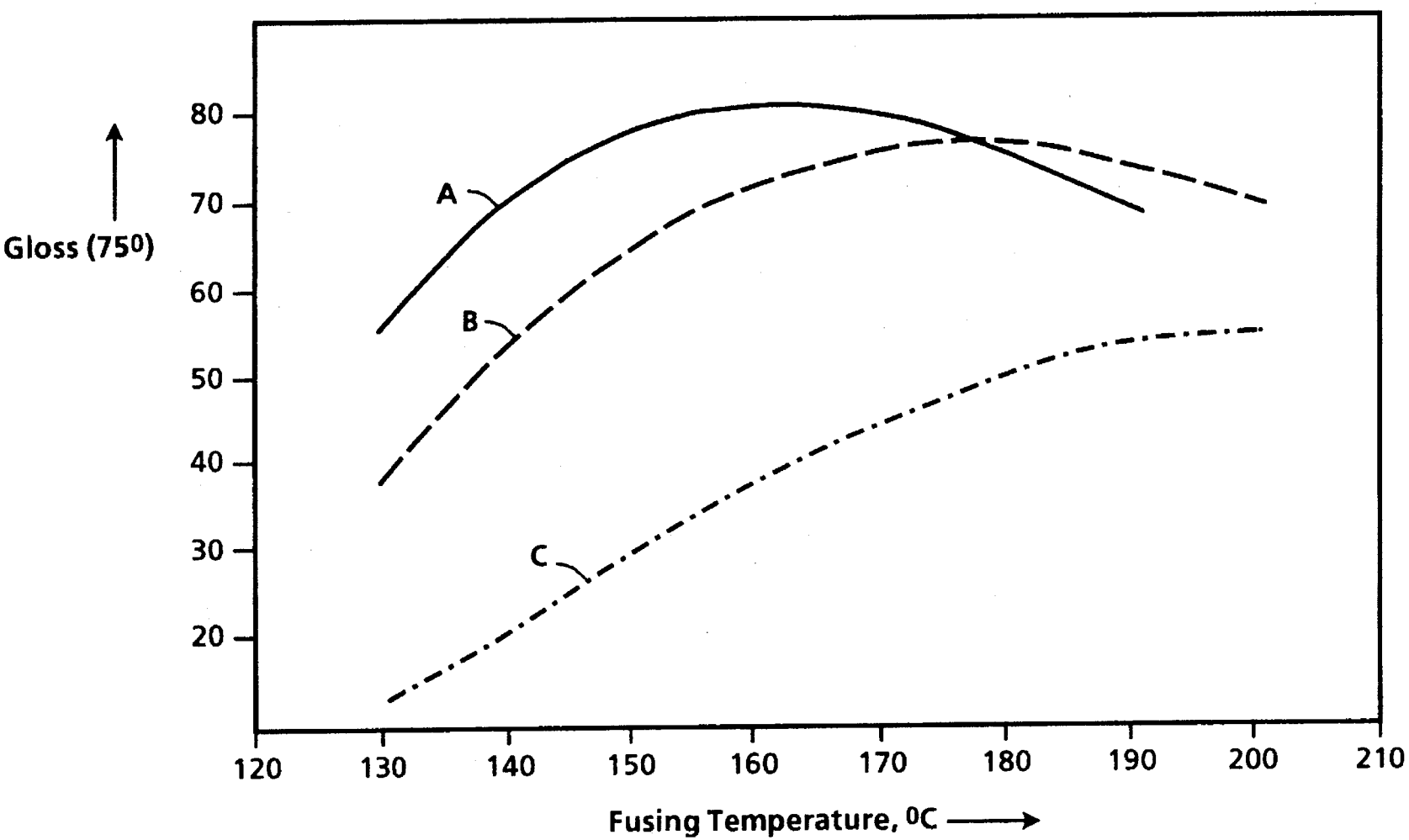
FIG. 1 illustrates the effect of fusing temperature on image gloss of various toners. Gloss curve A is for a linear unsaturated polyester, poly(propoxylated bisphenol A fumarate), low fix temperature resin with low fusing latitude and very short fuser life (thus, it is not believed to be effectively suitable for hot roll fusing). Gloss curve B is for crosslinked polyester, low fix temperature resins of the present invention with wide fusing, and gloss latitude and long fuser life (300,000 to 500,000 copies) useful in generating high gloss images, and wherein the microgel particles are present in the important amounts indicated herein, that is from 2 to 9 weight percent. Gloss curve C is for crosslinked polyester, low fix temperature resins with gel content in excess of 10 weight percent, and thus not useful in generating high gloss images.

There is a need for a high gloss crosslinked resin achievable with 1 to 10 percent by weight of a highly crosslinked portion in the form of microgels distributed throughout the linear portion, in the substantial absence of sol, in which the resin polymer is densely crosslinked without monomeric units between the crosslinked chains and the size of the gel particles does not grow with increasing degree of crosslinking, and which resin is useful in preparing high gloss toner resins for process color and other relevant applications. Furthermore, there is a need for an effective process for producing such a resin. The present invention provides such a resin which can be prepared by a reactive melt mixing process, and toners and developers thereof.

For applications, such as process color, the toner resin and toners thereof of the present invention enable images having high gloss with a gloss ranging from about 25 to about 80 gloss units, and preferably from about 25 to about 60 gloss units.

The present invention provides a low fix temperature, high gloss toner resin, and specifically a low fix temperature high gloss toner resin based on crosslinked resin comprised of crosslinked and linear portions, the crosslinked portion consisting essentially of microgel particles substantially uniformly distributed throughout the linear portion. In this resin, the crosslinked portion consists essentially of microgel particles, preferably up to about 0.1 micron, more preferably about 0.005 to about 0.1 micron, in average volume particle diameter as determined by scanning electron microscopy and transmission electron microscopy as well as by light scattering. When produced by a reactive melt mixing process wherein the crosslinking occurs at high temperature and under high shear, the size of the microgel particles does not continue to grow with increasing degree of crosslinking. Also, the microgel particles are distributed substantially uniformly throughout the linear portion.

The crosslinked portions or microgel particles are prepared in a manner that there is substantially no distance between the polymer chains (preferably the crosslinking lengths do not exceed one to two atoms). Thus, the crosslinking is not accomplished via monomer or polymer bridges. The polymer chains are directly connected, for example, at unsaturation sites or other reactive sites, or in some cases by a single intervening atom such as, for example, oxygen. Therefore, the crosslinked portions are very dense and do not swell as much as gel produced by conventional crosslinking methods. This crosslink structure is dissimilar from conventional crosslinking in which the crosslink distance between chains is quite large with several monomer units, and where the gels swell very well in a solvent such as tetrahydrofuran or toluene. These highly crosslinked dense microgel particles distributed throughout the linear portion impart elasticity to the resin which improves the resin offset properties, while not substantially affecting the resin minimum fix temperature.

The present invention provides a new type of toner resin having a low melt temperature and high gloss finish, which is preferably a partially crosslinked unsaturated resin such as unsaturated polyester prepared by crosslinking a linear unsaturated resin (hereinafter referred to as base resin), such as linear unsaturated polyester resin preferably with a chemical initiator in a melt mixing device such as, for example, an extruder at high temperature (e.g., above the melting temperature of the resin and preferably up to about 150° C. above that melting temperature) and under high shear (e.g., specific shear energy input of 0.1 to 0.5 kW-hr/kg). In preferred embodiments, the base resin has a degree of unsaturation of about 0.1 to about 30 mole percent, preferably about 5 to about 25 mole percent. The shear levels should be sufficient to inhibit microgel growth above about 0.1 micron average particle diameter, preferably from about 0.005 to about 0.1 micron, and to ensure substantially uniform distribution of the microgel particles. These shear levels are available in melt mixing devices such as extruders.

The toner resin of the present invention has a weight fraction of the microgel (gel content) in the resin mixture in the range typically from about 1 to about 10 weight percent, and preferably about 2 to about 9 weight percent. The rheology of the resulting resin is unique and specific for high gloss/low melt applications and is characterized by a sharp drop in viscosity at low temperature followed by a reduction in viscosity versus. temperature slope at higher temperatures. The uncrosslinked base resin, preferably unsaturated polyester, is present in the range of from about 90 to about 99.5 percent by weight of the toner resin, and preferably in the range from about 92 to 98 percent by weight of the toner resin. The uncrosslinked resin preferably comprises a low molecular weight reactive base resin which does not crosslink during the crosslinking reaction, such as an unsaturated polyester resin.

According to embodiments of the invention, the number average molecular weight (Mn) of the linear portion, as measured by gel permeation chromatography (GPC), is in the range typically of from about 1,000 to about 20,000, and preferably from about 2,000 to about 5,000. The weight average molecular weight ($M_w$) of the linear portion is in the range typically of from about 2,000 to about 40,000, and preferably from about 4,000 to about 20,000. The molecular weight distribution ($M_w/M_n$) of the linear portion is in the range typically of from about 1.5 to about 6, and preferably from about 2 to about 4. The onset glass transition temperature ($T_g$) of the linear portion as measured by differential scanning calorimetry (DSC) for preferred embodiments is in the range typically from about 50° C. to about 70° C., and preferably from about 51° C. to about 65° C. Melt viscosity of the linear portion in embodiments, as measured with a mechanical spectrometer at 10 radians per second, is from about 5,000 to about 200,000 poise, and preferably from about 20,000 to about 100,000 poise at 100° C. and drops sharply with increasing temperature to from about 100 to about 5,000 poise, and preferably from about 400 to about 2,000 poise, as the temperature increases from 100° C. to 130° C. Melt flow index of the linear portion in embodiments is from about 20 to about 80 grams per 10 minutes, as measured at 117° C. with a 2.16 kilogram weight.

The low melt/high gloss toner resin contains a mixture of crosslinked resin microgel particles and a linear portion as illustrated herein. In embodiments of the toner resin of the invention, the onset Tg is in the range typically from about 50° C. to about 70° C., and preferably from about 51° C. to about 65° C., and the melt flow index is in the range typically of from about 1 to about 40 grams per 10 minutes (measured at 117° C. with a 2.16 kilogram weight), and preferably from about 3 to about 30 grams per 10 minutes (measured at 117° C. with a 2.16 kilogram weight).

Figure 2:
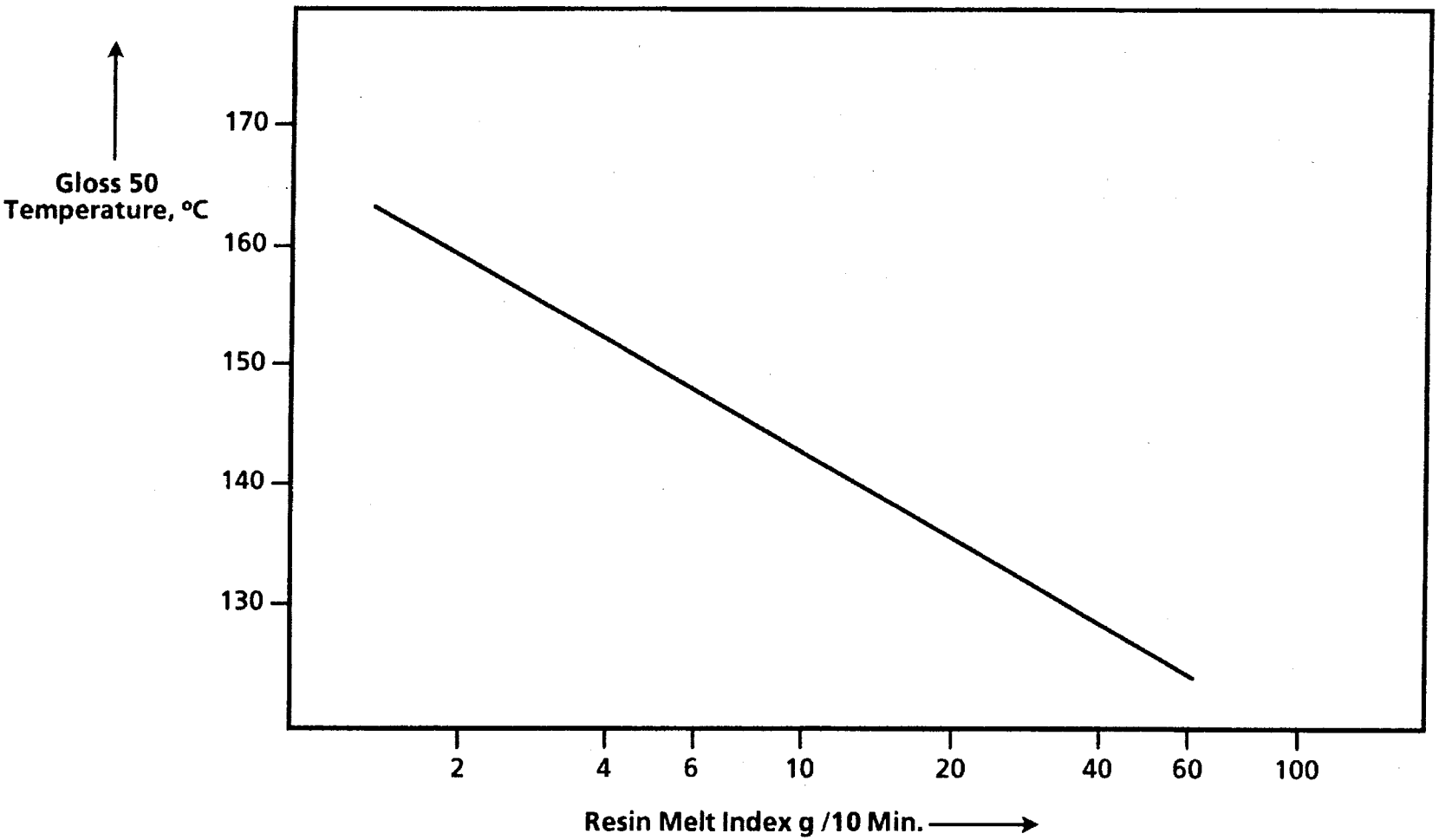
FIG. 2 illustrates the effect of resin melt flow index on image gloss.

The low fixing temperature of the toner resin of the present invention is a function of the molecular weight and molecular weight distribution of the linear portion, and is not affected by the amount of microgel particles or degree of crosslinking. The resin hot offset temperature is increased with the presence of microgel particles which impart elasticity to the resin. Low level of microgel content, for example from about 1 to about 10 weight percent, is required for high gloss application. The gloss level decreases with increasing microgel content as shown in FIG. 1, and with decreasing melt flow index as shown in FIG. 2.

The toner resin of the present invention can provide a low melt toner with a minimum fix temperature of from about 100° C. to about 200° C., preferably about 100° C. to about 160° C., more preferably about 110° C. to about 140° C., provide a low melt toner with a wide fusing and gloss latitude to minimize or prevent offset of the toner onto the fuser roll, and maintain high toner pulverization efficiencies and provide toner with a high gloss finish. The low melt toner resin preferably has a fusing latitude greater than 60° C., and from about 60° C. to about 100° C., and gloss latitude greater than 40° C., and from about 40° C. to about 100° C. The MFT of the toner is not believed to be sensitive to the crosslinking in the microgel particles of the toner resin. Toner resins and thus toners of the present invention possess minimized or substantially no vinyl offset. The toner resin of the present invention can provide a high gloss finish, for example from about 25 to about 80 gloss units, and more specifically, from about 25 to about 60 gloss units.

As the degree of crosslinking or microgel content decreases, the low temperature melt viscosity does not change appreciably, while the high temperature melt viscosity goes down and image gloss increases. This can be achieved by crosslinking in the melt state at high temperature and high shear such as, for example, by crosslinking an unsaturated polyester using a chemical initiator in an extruder resulting in the formation of microgel alone, distributed substantially uniformly throughout the linear portion, and substantially no intermediates or sol portions which are crosslinked polymers with low crosslinking density.

In a preferred embodiment, the crosslinked portion consists essentially of very high molecular weight microgel particles with high density crosslinking (measured by gel content) and which are not soluble in substantially any solvents such as, for example, tetrahydrofuran, toluene and the like. The microgel particles are highly crosslinked polymers with a very small crosslink distance; preferably the microgel particles are directly crosslinked. This type of crosslinked polymer may be formed by reacting chemical initiator with linear unsaturated polymer, and more preferably linear unsaturated polyester at high temperature and under high shear. The initiator molecule breaks into radicals and reacts with one or more double bond or other reactive site within the polymer chain forming a polymer radical. This polymer radical reacts with other polymer chains or polymer radicals many times forming a highly and directly crosslinked microgel. This renders the microgel very dense and results in the microgel not swelling well in solvent. The dense microgel also imparts elasticity to the resin and increases its hot offset temperature while not affecting its minimum fix temperature.

The weight fraction of the microgel (gel content) in the resin may be defined as follows:

$$\text{Gel Content} = \frac{\text{Total Sample Weight} - \text{Weight of Soluble Polymer}}{\text{Total Sample Weight}} \times 100\%$$

The gel content may be calculated by measuring the relative amounts of linear, soluble polymer and the nonlinear, crosslinked polymer utilizing the following procedure: (1) the sample of the crosslinked resin to be analyzed, in an amount between 145 and 235 milligrams, is weighed directly into a glass centrifuge tube; (2) 45 milliliters of toluene are added and the sample is put on a shaker for at least 3 hours, preferably overnight; (3) the sample is then centrifuged at about 2,500 rpm for 30 minutes and then a 5 milliliter aliquot is carefully removed and put into a preweighed aluminum dish; (4) the toluene is allowed to air evaporate for about 2 hours, and then the sample is further dried in a convection oven at 60° C. for about 6 hours or to constant weight; and (5) the sample remaining, times nine, gives the amount of soluble polymer. Thus, utilizing this quantity in the above equation, the gel content can be easily calculated.

Linear unsaturated polyesters, which may preferably be used as the base resin, are comprised of low molecular weight condensation polymers which may be formed by stepwise reactions between both saturated and unsaturated diacids (or anhydrides) and dihydric alcohols (glycols or diols). The resulting linear unsaturated polyesters are reactive (e.g., crosslinkable) on (i) unsaturation sites (double bonds) along the polyester chain, and (ii) functional groups such as carboxyl, hydroxy, etc. groups amenable to acid-base reactions. Typical unsaturated polyester base resins selected are prepared by melt polycondensation or other polymerization processes using diacids and/or anhydrides and diols. Suitable diacids and anhydrides include, but are not limited to saturated diacids and/or anhydrides such as, for example, succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like, and mixtures thereof; and unsaturated diacids and/or anhydrides, such as for example maleic acid, fumaric acid, chloromaleic acid, methacrylic acid, acrylic acid, itaconic acid, citraconic acid, mesaconic acid, maleic anhydride, and the like, and mixtures thereof. Suitable diols include, but are not limited to, for example, propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like, and mixtures thereof soluble in good solvents such as, for example, tetrahydrofuran, toluene and the like.

Preferred unsaturated polyester base resins are prepared from diacids and/or anhydrides such as, for example, maleic anhydride, fumaric acid, and the like, and mixtures thereof, and diols such as, for example, propoxylated bisphenol A, propylene glycol, and the like, and mixtures thereof. A particularly preferred polyester is poly(propoxylated bisphenol A fumarate).

Substantially any suitable unsaturated polyester can be used to prepare the toner resins of the present invention, including unsaturated polyesters known for use in toner resins and including unsaturated polyesters whose properties previously rendered them undesirable or unsuitable for use as toner resins (but which adverse properties are eliminated or reduced by preparing them in the partially crosslinked form of the present invention).

The crosslinking which occurs in the process of the invention is characterized by at least one reactive site (e.g., one unsaturation) within a polymer chain reacting substantially directly (e.g., with no intervening monomer(s)) with at least one reactive site within a second polymer chain, and by this reaction occurring repeatedly to form a series of crosslinked units. This polymer crosslinking reaction may occur by a number of mechanisms specifically as illustrated in U.S. Pat. No. 5,227,460, the entire disclosure of which is hereby incorporated by reference.

Chemical initiators, such as, for example, organic peroxides or azo-compounds, are preferred for preparing the crosslinked toner resins of the invention. Suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di(2-ethyl hexanoyl peroxy)hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy) hexane, oo-t-butyl o-(2-ethyl hexyl) mono peroxy carbonate, and oo-t-amyl o-(2-ethyl hexyl) mono peroxy carbonate, alkyl peroxides such as, for example, dicumyl peroxide, 2,5-dimethyl 2,5-di(t-butyl peroxy)hexane, t-butyl cumyl peroxide, α-α-bis(t-butyl peroxy) diisopropyl benzene, di-t-butyl peroxide and 2,5-dimethyl 2,5-di(t-butyl peroxy)hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy)valerate, 1,1-di(t-butyl peroxy) 3,3,5-trimethyl cyclohexane, 1,1-di(t-butyl peroxy)cyclohexane, 1,1-di(t-amyl peroxy)cyclohexane, 2,2-di(t-butyl peroxy)butane, ethyl 3,3-butyrate and ethyl 3,3-di(t-amyl peroxy-)butyrate. Suitable azo-compounds include azobis-isobutyronitrile, 2,2'-azobis(isobutyronitrile), 2,2'-azobis(2,4-dimethyl valeronitrile), 2,2'-azobis(methyl butyronitrile), 1,1'-azobis(cyano cyclohexane), and other similar known compounds.

By selecting low concentrations of chemical initiator, usually in the range of from about 0.01 to about 10 weight percent, and preferably in the range of from about 0.05 to about 1 weight percent, and consuming it in the crosslinking reaction, the residual contaminants produced in the crosslinking reaction in preferred embodiments can be minimal. Since the crosslinking can be accomplished at high temperature, the reaction is very rapid (e.g., less than 10 minutes, preferably about 2 seconds to about 5 minutes residence time) and thus little or no unreacted initiator remains in the product.

A small concentration of initiator is adequate to accomplish the crosslinking, usually in the range of from about 0.01 to about 4 percent by weight of initiator in the base resin, and preferably in the range of from about 0.05 to about 1 percent by weight of initiator in the base resin. These amounts of chemical initiator are preferred in obtaining the desired gel content according to the invention. By carrying out the crosslinking in the melt state at high temperature and high shear in a melt mixing device, such as an extruder, the gel particles formed during crosslinking are kept small (i.e. less than about 0.1 micron, and preferably about 0.005 to about 0.1 micron, in average volume particle diameter, as determined by scanning electron microscopy and transmission electron microscopy, as well as by light scattering) and their size does not grow with increasing degree of crosslinking. Also, the high shear enables the microgel particles to be substantially uniformly dispersed in the polymer melt.

An advantage of using a chemical initiator as the crosslinking agent is that by utilizing low concentrations of initiator (for example, less than 4 percent by weight and often less than 1 percent by weight) and accomplishing the crosslinking at high temperature, little or no unreacted initiator remains in the product, and therefore, the residual contaminants produced in the crosslinking reaction are minimal.

A reactive melt mixing process is a process wherein chemical reactions can be accomplished on the polymer in the melt phase in a melt mixing device, such as an extruder. In preparing the toner resins of the invention, these reactions are used to modify the chemical structure and the molecular weight, and thus the melt rheology and fusing properties of the polymer. Reactive melt mixing is particularly efficient for highly viscous materials, and is advantageous because it requires no solvents, and thus is easily environmentally controlled. It is also advantageous because it permits a high degree of initial mixing of resin and initiator to take place, and provides an environment wherein a controlled high temperature (adjustable along the length of the extruder) is available so that a very quick reaction can occur. it also enables a reaction to take place continuously, and thus the reaction is not limited by the disadvantages of a batch process, wherein the reaction must be repeatedly stopped so that the reaction products may be removed and the apparatus cleaned and prepared for another similar reaction. The important specific gel content (i.e. amount of crosslinking) may, for example, be regulated by the length of time the extrusion mixture is maintained at elevated temperature. When the desired amount of crosslinking is achieved, the reaction products can be quickly removed from the reaction chamber. The amount of initiator used may also control the amount of crosslinking. By providing a specific amount of initiator to effect a predetermined amount of crosslinking, the desired gel content (amount of crosslinking) is not exceeded.

High gloss low melt toners and toner resins may be prepared by a reactive melt mixing process wherein reactive resins are partially crosslinked. For example, low melt toner resins and toners may be fabricated by a reactive melt mixing process comprising the steps of (1) melting reactive base resin, thereby forming a polymer melt, in a melt mixing device; (2) initiating crosslinking of the polymer melt, preferably with a chemical crosslinking initiator and increased reaction temperature; (3) retaining the polymer melt in the melt mixing device for a sufficient residence time that partial crosslinking of the base resin may be achieved; (4) providing sufficiently high shear during the crosslinking reaction to retain the gel particles formed during crosslinking small in size and well distributed in the polymer melt; and (5) optionally devolatilizing the polymer melt to remove any effluent volatiles. The high temperature reactive melt mixing process allows for very fast crosslinking which enables the production of substantially only microgel particles, and the high shear of the process prevents undue growth of the microgels and enables the microgel particles to be uniformly distributed in the resin.

In a preferred embodiment, the process comprises the steps of (1) feeding base resin and initiator to an extruder; (2) melting the base resin, thereby forming a polymer melt; (3) mixing the molten base resin and initiator at low temperature to enable effective dispersion of the initiator in the base resin before the onset of crosslinking; (4) initiating crosslinking of the base resin with the initiator by raising the melt temperature and controlling it along the extruder channel; (5) retaining the polymer melt in the extruder for a sufficient residence time at a given temperature such that the required amount of crosslinking is achieved; (6) providing sufficiently high shear during the crosslinking reaction thereby keeping the gel particles formed during crosslinking small in size and well distributed in the polymer melt; (7) optionally devolatilizing the melt to remove any effluent volatiles; and (8) pumping the crosslinked resin melt through a die to a pelletizer. The resin may be prepared by a reactive melt mixing process disclosed in detail in copending U.S. Pat. No. 5,376,494, the disclosure of which is incorporated herein by reference.

In the process of the present invention, the fabrication of the crosslinked resin may be carried out in a melt mixing device such as an extruder described in U.S. Pat. No. 4,894,308, the disclosure of which is incorporated herein by reference. Generally, any high shear, high temperature melt mixing device suitable for processing polymer melts may be employed provided that the objectives of the present invention are achieved. Examples of continuous melt mixing devices include single screw extruders or twin screw extruders, continuous internal mixers, gear extruders, disc extruders and roll mill extruders. Examples of batch internal melt mixing devices include Banbury mixers, Brabender mixers and Haake mixers.

One suitable type of extruder is the fully intermeshing corotating twin screw extruder such as, for example, the ZSK-30 twin screw extruder, available from Werner & Pfleiderer Corporation, Ramsey, N.J., U.S.A., which has a screw diameter of 30.7 millimeters and a length-to-diameter (L/D) ratio of 37.2. The extruder enables melting of the base resin, mixing of the initiator into the base resin melt, providing high temperature and adequate residence time for the crosslinking reaction to be carried out, controlling the reaction temperature via appropriate temperature control along the extruder channel, optionally devolatilizing the melt to remove any effluent volatiles, and pumping the crosslinked polymer melt through a die such as, for example, a strand die to a pelletizer. For chemical reactions in highly viscous materials, reactive extrusion is particularly efficient, and is advantageous because it requires no solvents, and thus is easily environmentally controlled. It is also advantageous because it permits a high degree of initial mixing of base resin and initiator to take place, and provides an environment wherein a controlled high temperature (adjustable along the length of the extruder) is available so that a very quick, reaction can occur. It also enables the reaction to take place continuously, and thus the reaction is not limited by the disadvantages of a batch process, wherein the reaction must be repeatedly stopped so that the reaction products may be removed and the apparatus cleaned and prepared for another similar reaction. When the desired amount of crosslinking is achieved, the reaction products can be immediately removed from the reaction chamber.

Figure 3:
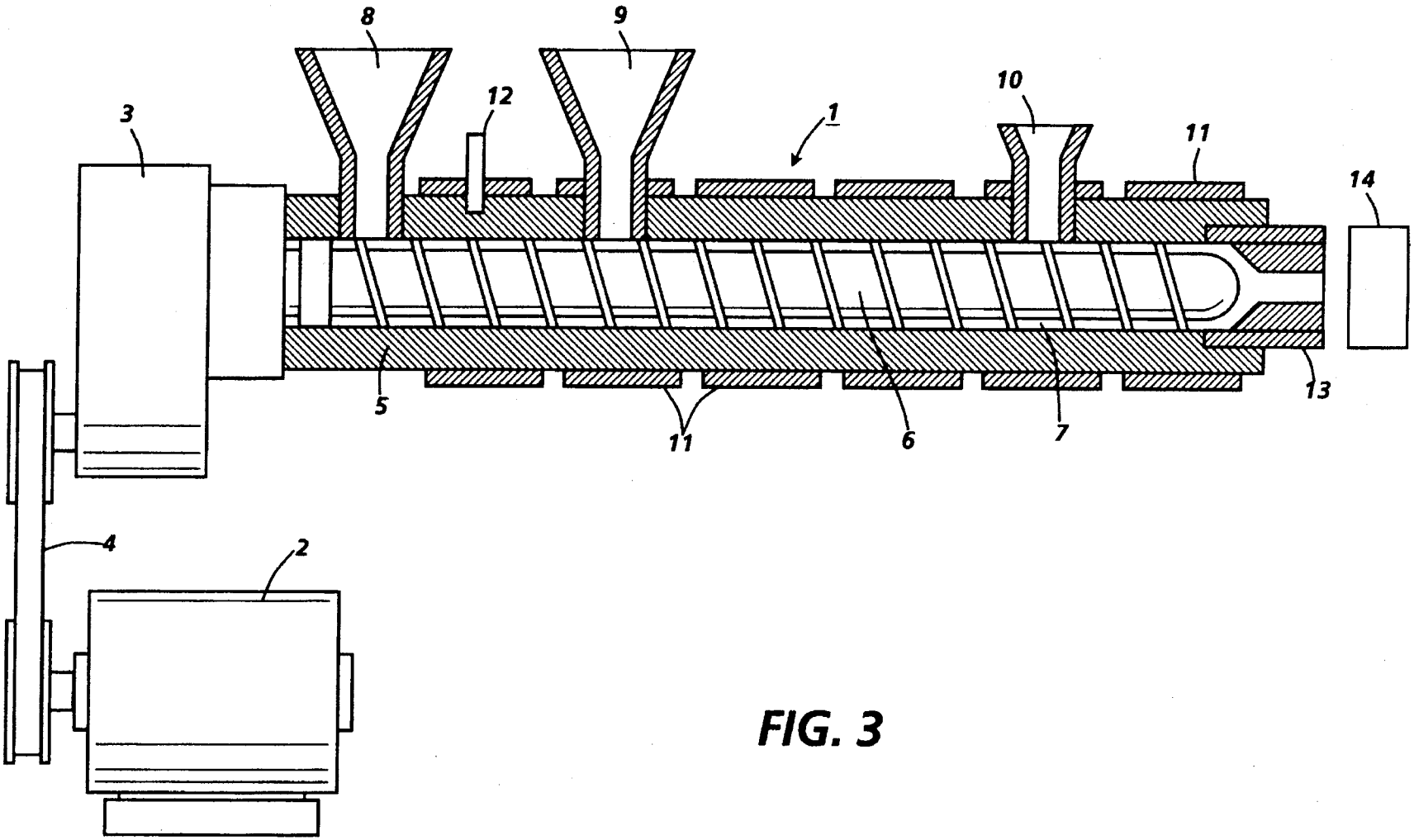
FIG. 3 is a partially schematic cross-sectional view of a reactive extrusion apparatus suitable for the process of the present invention.

For a better understanding of a process according to the present invention, a typical reactive extrusion apparatus suitable for the process of the present invention is illustrated in FIG. 3. FIG. 3 illustrates a twin screw extrusion device 1 containing a drive motor 2, a gear reducer 3, a drive belt 4, an extruder barrel 5, a screw 6, a screw channel 7, an upstream supply port or hopper 8, a downstream supply port 9, a downstream devolatilizer 10, a heater 11, a thermocouple 12, a die or head pressure generator 13, and a pelletizer 14. The barrel 5 consists of modular barrel sections, each separately heated with heater 11 and temperature controlled by thermocouple 12. With modular barrel sections, it is possible to locate feed ports and devolatilizing ports at required locations, and to provide segregated temperature control along the screw channel 7. The screw 6 is also modular, enabling the screw to be configured with modular screw elements and kneading elements having the appropriate lengths, pitch angles, etc. in such a way as to provide optimum conveying, mixing, reaction, devolatilizing and pumping conditions.

In operation, the components to be reacted and extruded, e.g., the base resin and chemical initiator, enter the extrusion apparatus from the first upstream supply port 8 and/or second downstream supply port 9. The base resin, usually in the form of solid pellets, chips, granules, or other forms can be fed to the first upstream supply port 8 and second downstream supply port 9 by starve feeding, gravity feeding, volumetric feeding, loss-in-weight feeding, or other known feeding methods. Feeding of the chemical initiator to the extruder depends in part on the nature of the initiator. In one embodiment of the invention, especially if the initiator is a solid, the base resin and initiator are preblended prior to being added to the extruder, and the preblend, the base resin and/or additional initiator may be added through either upstream supply port 8, downstream supply port 9, or both. In another embodiment, especially if the initiator is a liquid, the base resin and initiator can preferably be added to the extruder separately through upstream supply port 8, downstream supply port 9, or both. This does not preclude other methods of adding the base resin and initiator to the extruder. After the base resin and initiator have been fed into screw channel 7, the resin is melted and the initiator is dispersed into the molten resin as it is heated, but preferably still at a lower temperature than is needed for crosslinking. Heating takes place from two sources: (1) external barrel heating from heaters 11, and (2) internal heating from viscous dissipation within the polymer melt itself. When the temperature of the molten resin and initiator reach a critical point, onset of the crosslinking reaction takes place. It is preferable, although not absolutely necessary, that ,the time required for completion of the crosslinking reaction not exceed the residence time in the screw channel 7. The rotational speed of the extruder screw preferably ranges from about 50 to about 500 revolutions per minute. If needed, volatiles may be removed through downstream devolatilizer 10 by applying a vacuum. At the end of screw channel 7, the crosslinked resin is pumped in molten form through die 13, such as for example a strand die, to pelletizer 14 such as, for example, a water bath pelletizer, underwater granulator, and the like.

With further reference to FIG. 3, the rotational speed of the screw 6 can be of any suitable value provided that the objectives of the present invention are achieved. Generally, the rotational speed of screw 6 is from about 50 revolutions per minute to about 500 revolutions per minute. The barrel temperature, which is controlled by thermocouples 12 and generated in part by heaters 11, is from about 40° C. to about 250° C. The temperature range for mixing the base resin and initiator in the upstream barrel zones is from about the melting temperature of the base resin to below the crosslinking onset temperature, and preferably within about 40° C. of the melting temperature of the base resin. For example, for an unsaturated polyester base resin the temperature is preferably about 90° C. to about 130° C. The temperature range for the crosslinking reaction in the downstream barrel zones is above the crosslinking onset temperature and the base resin melting temperature, preferably within about 150° C. of the base resin melting temperature. For example, for an unsaturated polyester base resin, the temperature is preferably about 90° C. to about 250° C. The die or head pressure generator 13 generates pressure from about 50 pounds per square inch to about 500 pounds per square inch. In one embodiment, the screw is allowed to rotate at about 100 revolutions per minute, the temperature along barrel 5 is maintained at about 70° C. in the first barrel section and 160° C. further downstream, and the die pressure is about 50 pounds per square inch.

When crosslinking in a batch internal melt mixing device, the residence time is preferably in the range of about 10 seconds to about 5 minutes. The rotational speed of a rotor in the device is preferably about 10 to about 500 revolutions per minute.

The resins of the present invention are generally present in the toner of the present invention in an amount of from about 40 to about 98 percent by weight, and more preferably from about 70 to about 98 percent by weight. For example, toner resins of the present invention can be subsequently melt blended or otherwise mixed with a colorant, charge carrier additives, surfactants, emulsifiers, pigment dispersants, flow additives, and the like. The resultant product can then be pulverized by known methods, such as milling, to form toner particles. The toner particles preferably have an average volume particle diameter of about 5 to about 25, more preferably about 5 to about 15 microns.

Various suitable colorants can be employed in the toners of the invention, including suitable colored pigments, dyes, and mixtures thereof including carbon black, such as REGAL 330® carbon black (Cabot), Acetylene Black, Lamp Black, Aniline Black, Chrome Yellow, Zinc Yellow, Sicofast Yellow, Luna Yellow, Novaperm Yellow, Chrome Orange, Bayplast Orange, Cadmium Red, LITHOL SCARLET™, HOSTAPERM RED™, FANAL PINK™, HOSTAPERM PINK™, Lithol Red, Rhodamine Lake B, Brilliant Carmine, Heliogen Blue, HOSTAPERM BLUE™, NEOPAN BLUE™, PV FAST BLUE™, Cinquassi Green, Hostaperm Green, titanium dioxide, cobalt, nickel, iron powder, SICOPUR 4068 FF™, and iron oxides such as MAPICO BLACK™ (Columbia), NP608™ and NP604™ (Northern Pigment), BAYFERROX 8610™ (Bayer), MO8699™ (Mobay), TMB-100™ (Magnox), mixtures thereof and the like.

The colorant, preferably carbon black, cyan, magenta and/or yellow colorant, is incorporated in an amount sufficient to impart the desired color to the toner. In general, pigment or dye is employed in an amount ranging from about 2 to about 60 percent by weight, and preferably from about 2 to about 7 percent by weight for color toner and about 5 to about 60 percent by weight for black toner.

Various known suitable effective positive or negative charge enhancing additives can be selected for incorporation into the toner compositions of the present invention, preferably in an amount of about 0.1 to about 10, more preferably about 1 to about 3 percent by weight. Examples include quaternary ammonium compounds inclusive of alkyl pyridinium halides; alkyl pyridinium compounds, reference U.S. Pat. No. 4,298,672, the disclosure of which is totally incorporated hereby by reference; organic sulfate and sulfonate compositions, U.S. Pat. No. 4,338,390, the disclosure of which is totally incorporated hereby by reference; cetyl pyridinium tetrafluoroborates; distearyl dimethyl ammonium methyl sulfate; aluminum complex salts, such as BONTRON E84™ or E88™ (Hodogaya Chemical); and the like.

Additionally, other internal and/or external additives may be added in known amounts for their known functions, including waxes such as polypropylene, polyethylene, and the like; metal oxides, colloidal silicas, UNILIN® alcohols, and the like.

The toner particles can be formulated into a developer composition by mixing with carrier particles. Illustrative examples of carrier particles that can be selected for mixing with the toner composition of the present invention include those particles that are capable of triboelectrically obtaining a charge of opposite polarity to that of the toner particles. Accordingly, in embodiments the carrier particles may be selected so as to be of a negative polarity in order that the toner particles which are positively charged will adhere to and surround the carrier particles. Illustrative examples of carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the entire disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated herein by reference.

The selected carrier particles can be used with or without a coating. The coating generally can be comprised of fluoropolymers, such as polyvinylidene fluoride resins, terpolymers of styrene, methyl methacrylate, and a silane, such as triethoxy silane, tetrafluoroethylenes, other known coatings and the like.

The diameter of the carrier particles is generally from about 50 microns to about 1,000 microns, preferably from about 50 to about 200 microns, thus allowing these particles to possess sufficient density and inertia to avoid adherence to the electrostatic images during the development process. The carrier particles can be mixed with the toner particles in various suitable combinations. However, best results are obtained when about 1 part carrier to about 10 parts to about 200 parts by weight of toner are mixed.

Toners of the invention can be used in known electrostatographic imaging methods, and the fusing energy requirements of some of those methods can be reduced in view of the advantageous fusing properties of the toner of the invention as discussed herein. Thus, for example, the toners or developers of the present invention can be charged, e.g. triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example, with a heated fuser roll at a temperature lower than 200° C., preferably lower than 160° C., and more preferably from about 110° C. to about 140° C.

The invention will further be illustrated in the following, nonlimiting Examples, it being understood that these Examples are intended to be illustrative only and that the invention is not intended to be limited to the materials, conditions, process parameters and the like recited herein. Parts and percentages are by weight unless otherwise indicated.

EXAMPLE I

A crosslinked unsaturated polyester resin is prepared by reacting 99.2 percent by weight of a linear bisphenol A fumarate polyester base resin with a $M_n$ of about 4,200, a $M_w$ of about 11,000, a $M_w/M_n$ of about 2.62 as measured by GPC, onset Tg of about 55° C. as measured by DSC, and melt flow index of about 50 grams per 10 minutes (measured at 117° C. with a 2.16 kilogram weight), and which contains about 1,200 parts per million of hydroquinone and 0.8 percent by weight of benzoyl peroxide initiator as follows.

The unsaturated polyester base resin and benzoyl peroxide initiator are blended in a rotary tumble blender for 30 minutes. The resulting dry mixture is then fed into a Werner & Pfleiderer ZSK-30 twin screw extruder with a screw diameter of 30.7 millimeters and a length-to-diameter (L/D) ratio of 37.2 at 10 pounds per hour using a loss-in-weight feeder. The crosslinking is carried out in the extruder using the following process conditions: barrel temperature profile of 70°/160°/160°/160°/160°/160°/160° C., die head temperature of 160° C., screw rotational speed of 100 revolutions per minute and average residence time of about three minutes. The extrudate melt, upon exiting from the strand die, is cooled in a water bath and pelletized. The crosslinked polyester product has an onset Tg of about 54° C. as measured by DSC, melt flow index of about 20 grams per 10 minutes (measured at 117° C. with a 2.16 kilogram weight), a gel content of about 2 weight percent and a mean microgel particle size of about 0.1 micron as determined by transmission electron microscopy.

The linear and crosslinked portions of the product are separated by dissolving the product in tetrahydrofuran and filtering off the microgel. The dissolved part is reclaimed by evaporating the tetrahydrofuran. This linear part of the resin, when characterized by GPC, is found to have $M_n$ of about 4,200, $M_w$ of about 11,000, $M_w/M_n$ of about 2.62, and onset Tg of about 54° C., which is substantially the same as the original noncrosslinked base resin, indicating it contains no sol.

Thereafter, a toner is formulated by melt mixing the above prepared crosslinked unsaturated polyester resin, 98 percent by weight, with 2 percent by weight of PV FAST BLUE™ pigment in a Haake batch mixer. The toner is pulverized and classified to form a toner with an average particle diameter of about 6.8 microns and a geometric size distribution (GSD) of about 1.30. The toner is evaluated for fixing, gloss, blocking, and vinyl offset performance. The results in Table 1 indicate that the toner minimum fix temperature is about 132° C., the hot offset temperature is about 200° C., the fusing latitude is about 68° C., the gloss 50 temperature is about 135° C., the gloss latitude is about 65° C., and the peak gloss is about 80 gloss units when the following fusing conditions are utilized: process speed of about 160 millimeters per second, dwell time of about 37.5 milliseconds, and fuser oil application rate of about 25 micrograms per copy. Also, the toner has excellent blocking performance (about 53° C. as measured by DSC) and evidenced no apparent vinyl offset. The fuser life was 300,000 copies.

EXAMPLE II

A crosslinked unsaturated polyester resin is prepared by reacting 99.15 percent by weight of a linear bisphenol A fumarate polyester base resin with the properties described in Example I:, and 0.85 percent by weight of benzoyl peroxide initiator as outlined in the following procedure.

The unsaturated polyester base resin and benzoyl peroxide initiator are blended in a rotary tumble blender for 30 minutes. The resulting dry mixture is then fed into a Werner & Pfleiderer ZSK-30 twin screw extruder with a screw diameter of 30.7 millimeters and a length-to-diameter (L/D) ratio of 37.2 at 10 pounds per hour using a loss-in-weight feeder. The crosslinking is carried out in the extruder using the following process conditions: barrel temperature profile of 70°/160°/160°/160°/160°/160°/160° C., die head temperature of 160° C., screw rotational speed of 100 revolutions per minute, and average residence time of about three minutes. The extrudate melt, upon exiting from the strand die, is cooled in a water bath and pelletized. The crosslinked polyester product has an onset Tg of about 54° C. as measured by DSC, melt flow index of about 11 grams per 10 minutes (measured at 117° C. with a 2.16 kilogram weight), a gel content of about 5 weight percent, and a mean microgel particle size of about 0.1 micron as determined by transmission electron microscopy.

The linear and crosslinked portions of the product are separated by dissolving the product in tetrahydrofuran and filtering off the microgel. The dissolved part is reclaimed by evaporating the tetrahydrofuran. This linear part of the resin, when characterized by GPC, is found to have $M_n$ of about 4,200, $M_w$ of about 11,000, $M_w/M_n$ of about 2.62, and onset Tg of about 54° C., which is substantially the same as the original noncrosslinked base resin, indicating it contains no sol.

Thereafter, a toner is prepared and evaluated according to the procedure of Example I, except that the toner average particle diameter is about 7.3 microns and the GSD is about 1.29. The results in Table 1 indicate that the minimum fix temperature is about 131° C., the hot offset temperature is greater than 200° C., the fusing latitude is greater than 69° C., the gloss 50 temperature is about 142° C., the gloss latitude is greater than 58° C., and the peak gloss is about 78 gloss units. Also, the toner has excellent blocking performance (about 53° C. as measured by DSC) and evidences no apparent vinyl offset. The fuser life exceeds 300,000 copies.

EXAMPLE III

A crosslinked unsaturated polyester resin is prepared by reacting 99.1 percent by weight of a linear bisphenol A fumarate polyester base resin with properties described in Example I, and 0.9 percent by weight of benzoyl peroxide initiator as outlined in the following procedure.

The unsaturated polyester base resin and benzoyl peroxide initiator are blended in a rotary tumble blender for 30 minutes. The resulting dry mixture is then fed into a Werner & Pfleiderer ZSK-30 twin screw extruder with a screw diameter of 30.7 millimeters and a length-to-diameter (L/D) ratio of 37.2 at 10 pounds per hour using a loss-in-weight feeder. The crosslinking is carried out in the extruder using the following process conditions: barrel temperature profile of 70°/160°/160°/160°/160°/160°/160° C., die head temperature of 160° C., screw rotational speed of 100 revolutions per minute, and average residence time of about three minutes. The extrudate melt, upon exiting from the strand die, is cooled in a water bath and pelletized. The crosslinked polyester product has an onset Tg of about 54° C. as measured by DSC, melt flow index of about 6.5 grams per 10 minutes (measured at 117° C. with a 2.16 kilogram weight), a gel content of about 7 weight percent, and a mean microgel particle size of about 0.1 micron as determined by transmission electron microscopy.

The linear and crosslinked portions of the product are separated by dissolving the product in tetrahydrofuran and filtering off the microgel. The dissolved part is reclaimed by evaporating the tetrahydrofuran. This linear part of the resin, when characterized by GPC, is found to have $M_n$ of about 4,100, $M_w$ of about 10,900, $M_w/M_n$ of about 2.66, and onset Tg of about 54° C., which is substantially the same as the original noncrosslinked base resin, indicating it contains no sol.

Thereafter, a toner is prepared and evaluated according to the procedure of Example I, except that the average particle diameter is about 7.0 microns and the GSD is about 1.31. The results in Table 1 show that the minimum fix temperature is about 132° C., the hot offset temperature is greater than 200° C., the fusing latitude is greater than 68° C., the gloss 50 temperature is about 149° C., the gloss latitude is greater than 51° C., and the peak gloss is about 75 gloss units. Also, the toner has excellent blocking performance (about 53° C. as measured by DSC) and evidences no apparent vinyl offset. The fuser life was in excess of 300,000 copies.

EXAMPLE IV

A crosslinked unsaturated polyester resin is prepared by reacting 99.05 percent by weight of a linear bisphenol A fumarate polyester base resin with properties described in Example I:, and 0.95 percent by weight of benzoyl peroxide initiator as outlined in the following procedure.

The unsaturated polyester base resin and benzoyl peroxide initiator are blended in a rotary tumble blender for 30 minutes. The resulting dry mixture is then fed into a Werner & Pfleiderer ZSK-30 twin screw extruder with a screw diameter of 30.7 millimeters and a length-to-diameter (L/D) ratio of 37.2 at 10 pounds per hour using a loss-in-weight feeder. The crosslinking is carried out in the extruder using the following process conditions: barrel temperature profile of 70°/160°/160°/160°/160°/160°/160° C., die head temperature of 160° C., screw rotational speed of 100 revolutions per minute and average residence time of about three minutes. The extrudate melt, upon exiting from the strand die, is cooled in a water bath and pelletized. The crosslinked polyester product has an onset Tg of about 54° C. as measured by DSC, melt flow index of about 3 grams per 10 minutes (measured at 117° C. with a 2.16 kilogram weight), a gel content of about 9 weight percent and a mean microgel particle size of about 0.1 micron as determined by transmission electron microscopy.

The linear and crosslinked portions of the product are separated by dissolving the product in tetrahydrofuran and filtering off the microgel. The dissolved part is reclaimed by evaporating the tetrahydrofuran. This linear part of the resin, when characterized by GPC, is found to have $M_n$ of about 4,100, $M_w$ of about 10,900, $M_w/M_n$ of about 2.66, and onset Tg of about 54° C., which is substantially the same as the original noncrosslinked base resin, indicating it contains no sol.

Thereafter, a toner is prepared and evaluated according to the procedure of Example I, except that the average particle diameter is about 7.4 microns and the GSD is about 1.28. The results in Table 1 show that the minimum fix temperature is about 133° C., the hot offset temperature is greater than 200° C., the fusing latitude is greater than 67° C., the gloss 50 temperature is about 155° C., the gloss latitude is greater than 45° C., and the peak gloss is about 72 gloss units. Also, the toner has excellent blocking performance (about 53° C. as measured by DSC) and evidences no apparent vinyl offset. The fuser life exceeds 300,000 copies.

EXAMPLE V

A crosslinked unsaturated polyester resin is prepared by reacting 99.75 percent by weight of a linear bisphenol A fumarate polyester base resin having $M_n$ of about 5,300, $M_w$ of about 16,100, $M_w/M_n$ of about 3.04 as measured by GPC, onset Tg of about 56° C. as measured by DSC, and melt flow index of about 32 grams per 10 minutes (measured at 117° C. with a 2.16 kilogram weight), and contains about 50 parts per million of hydroquinone and 0.25 percent by weight of benzoyl peroxide initiator as outlined in the following procedure.

The unsaturated polyester base resin and benzoyl peroxide initiator are blended in a rotary tumble blender for 30 minutes. The resulting dry mixture is then fed into a Werner & Pfleiderer ZSK-30 twin screw extruder with a screw diameter of 30.7 millimeters and a length-to-diameter (L/D) ratio of 37.2 at 10 pounds per hour using a loss-in-weight feeder. The crosslinking is carried out in the extruder using the following process conditions: barrel temperature profile of 70°/160°/160°/160°/160°/160°/160° C., die head temperature of 160° C., screw rotational speed of 100 revolutions per minute and average residence time of about three minutes. The extrudate melt, upon exiting from the strand die, is cooled in a water bath and pelletized. The crosslinked polyester product has an onset Tg of about 54° C. as measured by DSC, melt flow index of about 5.5 grams per 10 minutes (measured at 117° C. with a 2.16 kilogram weight), a gel content of about 6 weight percent, and a mean microgel particle size of about 0.1 micron as determined by transmission electron microscopy.

The linear and crosslinked portions of the product are separated by dissolving the product in tetrahydrofuran and filtering off the microgel. The dissolved part is reclaimed by evaporating the tetrahydrofuran. This linear part of the resin, when characterized by GPC, is found to have $M_n$ of about 5,200, $M_w$ of about 16,000, $M_w/M_n$ of about 3.08, and onset Tg of about 55° C., which is substantially the same as the original noncrosslinked base resin, indicating it contains no sol.

Thereafter, a toner is prepared and evaluated according to the procedure of Example I, except that the average particle diameter is about 7.1 microns and the GSD is about 1.32. The results in Table 1 show that the minimum fix temperature is about 133° C., the hot offset temperature is greater than 200° C., the fusing latitude is greater than 67° C., the gloss 50 temperature is about 151° C., the gloss latitude is greater than 49° C., and the peak gloss is about 74 gloss units. Also, the toner has excellent blocking performance (about 54° C. as measured by DSC) and evidences no apparent vinyl offset. The fuser life exceeds 300,000 copies.

COMPARATIVE EXAMPLE 1 (C-1)

A crosslinked unsaturated polyester resin is prepared by reacting 99.3 percent by weight of a linear bisphenol A fumarate polyester base resin with properties described in Example I, and 0.7 percent by weight benzoyl peroxide initiator as outlined in the following. procedure.

The unsaturated polyester base resin and benzoyl peroxide initiator are blended in a rotary tumble blender for 30 minutes. The resulting dry mixture is then fed into a Werner & Pfleiderer ZSK-30 twin screw extruder with a screw diameter of 30.7 millimeters and a length-to-diameter (L/D) ratio of 37.2 at 10 pounds per hour using a loss-in-weight feeder. The crosslinking is carried out in the extruder using the following process conditions: barrel temperature profile of 70°/160°/160°/160°/160°/160°/160° C., die head temperature of 160° C., screw rotational speed of 100 revolutions per minute, and average residence time of about three minutes. The extrudate melt, upon exiting from the strand die, is cooled in a water bath and pelletized. The crosslinked polyester product has an onset Tg of about 54° C. as measured by DSC, melt flow index of about 40 grams per 10 minutes (measured at 117° C. with a 2.16 kilogram weight), a gel content of about 0.6 weight percent and a mean microgel particle size of about 0.1 micron as determined by transmission electron microscopy.

The linear and crosslinked portions of the product are separated by dissolving the product in tetrahydrofuran and filtering off the microgel. The dissolved part is reclaimed by evaporating the tetrahydrofuran. This linear part of the resin, when characterized by GPC, is found to have $M_n$ of about 4,200, $M_w$ of about 11,000, $M_w/M_n$ of about 2.62, and onset Tg of about 54° C., which is substantially the same as the original noncrosslinked base resin, indicating it contains no sol.

Thereafter, a toner is prepared and evaluated according to the same procedure as in Example I, except that the average particle diameter is about 7.4 microns and the GSD is about 1.32. The results in Table 1 show that the minimum fix temperature is about 131° C., the hot offset temperature is about 190° C., the fusing latitude is 59° C., the gloss 50 temperature is about 128° C., the gloss latitude is about 62° C., and the peak gloss is about 82 gloss units. Also, the toner has excellent blocking performance (about 53° C. as measured by DSC) and shows no apparent vinyl offset. However, the fuser failed at less than 300,000 copies due previously to toner offset.

COMPARATIVE EXAMPLE 2 (C-2)

A crosslinked unsaturated polyester resin is prepared by reacting 99.0 percent by weight of a linear bisphenol A fumarate polyester base resin with properties described in Example I, and 1.0 percent by weight of benzoyl peroxide initiator as outlined in the following procedure.

The unsaturated polyester base resin and benzoyl peroxide initiator are blended in a rotary tumble blender for 30 minutes. The resulting dry mixture is then fed into a Werner & Pfleiderer ZSK-30 twin screw extruder with a screw diameter of 30.7 millimeters and a length-to-diameter (L/D) ratio of 37.2, at 10 pounds per hour using a loss-in-weight feeder. The crosslinking is carried out in the extruder using the following process conditions: barrel temperature profile of 70°/160°/160°/160°/160°/160°/160° C., die head temperature of 160° C., screw rotational speed of 100 revolutions per minute and average residence time of about three minutes. The extrudate melt, upon exiting from the strand die, is cooled in a water bath and pelletized. The crosslinked polyester product has an onset Tg of about 54° C. as measured by DSC, melt flow index of about 2 grams per 10 minutes (measured at 117° C. with a 2.16 kilogram weight), a gel content of about 12 weight percent and a mean microgel particle size of about 0.1 micron as determined by transmission electron microscopy.

The linear and crosslinked portions of the product are separated by dissolving the product in tetrahydrofuran and filtering off the microgel. The dissolved part is reclaimed by evaporating the tetrahydrofuran. This linear part of the resin, when characterized by GPC, is found to have $M_n$ of about 4,100, $M_w$ of about 10,900, $M_w/M_n$ of about 2.66, and onset Tg of about 54° C., which is substantially the same as the original noncrosslinked base resin, indicating it contains no sol.

Thereafter, a toner is prepared and evaluated according to the same procedure as in Example I, except that the average particle diameter is about 7.6 microns and the GSD is about 1.27. The results in Table 1 show that the minimum fix temperature is about 133° C., the hot offset temperature is greater than 200° C., the fusing latitude is greater than 67° C., the gloss 50 temperature is about 162° C., which is higher than desired, the gloss latitude is greater than 38° C., and the peak gloss is about 70 gloss units. Also, the toner has excellent blocking performance (about 53° C. as measured by DSC) and shows no apparent vinyl offset. The fuser life exceeds 300,000 copies.

TABLE 1

SUMMARY OF EXAMPLES I TO V

| Ex. | Sol, % | Gel, % | MFT, °C. | HOT, °C. | FL, °C. | T ($G_{50}$), °C. | GL, °C. | Peak Gloss, gu |
|---|---|---|---|---|---|---|---|---|
| I | 0 | 2 | 132 | 200 | 68 | 135 | 65 | 80 |
| II | 0 | 5 | 131 | >200 | >69 | 142 | >58 | 78 |
| III | 0 | 7 | 132 | >200 | >68 | 149 | >51 | 75 |
| IV | 0 | 9 | 133 | >200 | >67 | 155 | >45 | 72 |
| V | 0 | 6 | 133 | >200 | >67 | 151 | >49 | 74 |
| C-1 | 0 | 0.6 | 131 | 190 | 59 | 128 | 62 | 82 |
| C-2 | 0 | 12 | 133 | >200 | >67 | 162 | >38 | 70 |

The fuser life in all instances was greater than 300,000 copies, except for C-1 wherein the fuser life was Less than 300,000 copies, about 295,000 copies.

Other embodiments and modifications of the present invention may occur to those skilled in the art subsequent to a review of the information presented herein; these embodiments and modifications, as well as equivalents thereof, are also included within the scope of this invention.

What is claimed is

1. A toner resin comprising uncrosslinked portions and crosslinked portions, said crosslinked portions being comprised of high density crosslinked microgel particles, wherein said microgel particles have a gel content of from about 2 to about 9 weight percent, and wherein said resin is substantially free of sol.

2. The toner resin of claim 1 wherein said microgel particles are about 0.005 to about 0.1 micron in average volume diameter and are substantially uniformly distributed in said resin, and said microgel particles gel content is from 2 to 9 percent by weight.

3. The toner resin of claim 1 wherein said microgel particles have no more than a single bridging molecule between crosslinked chains.

4. The toner resin of claim 1 wherein said microgel particles are directly crosslinked.

5. The toner resin of claim 1 wherein said linear portions comprise linear unsaturated polyester resin.

6. The toner resin of claim 5 wherein said linear unsaturated polyester resin is poly(propoxylated bisphenol A fumarate).

7. The toner resin of claim 1 wherein said linear portions have a number average molecular weight, $M_n$, as measured by gel permeation chromatography, in the range of from about 1,000 to about 20,000; a weight average molecular weight, $M_w$, in the range of from about 2,000 to about 40,000; and a molecular weight distribution, $M_w/M_n$, in the range of from about 1.5 to about 6.

8. The toner resin of claim 1 wherein said linear portions have an onset glass transition temperature ($T_g$) as measured by differential scanning calorimetry in the range of from about 50° C. to about 70° C.

9. The toner resin of claim 1 wherein said linear portions have a melt viscosity as measured with a mechanical spectrometer at 10 radians per second, of from about 5,000 to about 200,000 poise at 100° C., and said melt viscosity drops sharply with increasing temperature to from about 100 to about 5,000 poise as the temperature increases from 100° C. to 130° C., and a melt flow index of from about 20 to about 80 grams per 10 minutes as measured at 117° C. with a 2.16 kilogram weight.

10. The toner resin of claim 1 wherein said resin has a minimum fix temperature of from about 100° C. to about 160° C.

11. The toner resin of claim 1 wherein said resin has a fusing latitude of from about 60° C. to about 100° C.

12. The toner resin of claim 1 wherein said resin has a gloss latitude of from about 40° C. to about 100° C.

13. The toner resin of claim 1 wherein said resin is prepared by a high temperature, high shear reactive melt mixing process, and wherein said resin possesses high gloss and low melting characteristics.

14. A toner prepared from the resin of claim 1 and which toner has a high gloss of from about 25 to about 80 gloss units.

15. A low fix temperature, low gloss toner comprising colorant and toner resin, said toner resin consisting essentially of an uncrosslinked phase and highly crosslinked microgel particles present in an amount of from about 2 to about 9 percent by weight of said toner resin, and wherein said resin is substantially free of sol.

16. The toner of claim 15 wherein said toner resin comprises unsaturated polyester linear polymer.

17. The toner of claim 15 wherein said microgel particles have an average diameter of up to about 0.1 micron and are substantially uniformly dispersed in said uncrosslinked phase, and the colorant is carbon black, cyan, magenta, yellow, blue, red or mixtures thereof.

18. The toner of claim 15 wherein said toner resin has an onset glass transition temperature of about 50° C. to about 70° C., and a melt flow index of from about 1 to about 40 grams per 10 minutes as measured at 117° C. with a 2.16 kilogram weight

19. The toner of claim 15 wherein said toner has a minimum fix temperature of from about 100° C. to about 160° C.

20. The toner of claim 15 wherein said toner has a fusing latitude of from about 60° C. to about 100° C.

21. The toner of claim 15 wherein said toner has a gloss latitude of from about 40° C. to about 100° C.

22. The toner of claim 15 wherein said toner resin is prepared by a high shear, high temperature reactive melt mixing process.

23. The toner of claim 15 wherein said toner has a gloss of from about 25 to about 80 gloss units.

24. A reactive melt mixing process for preparing low fix temperature, high gloss toner resin substantially free of sol comprising linear and crosslinked portions, said crosslinked portions comprised of high density, crosslinked microgel particles comprising (a) melting a reactive base resin, thereby forming a polymer melt; and (b) crosslinking a portion of said polymer melt under high shear to form uniformly dispersed microgel particles with a gel content of from 2 to 9 percent by weight of said toner resin.

25. The process of claim 24 wherein said process is a batch melt mixing process.

26. The process of claim 24 wherein a chemical initiator is used as a crosslinking agent.

27. The process of claim 26 wherein the weight fraction of said chemical initiator in said base resin is less than 4 weight percent.

28. The process of claim 24 further comprising the step of mixing said reactive base resin and a chemical initiator prior to forming said polymer melt.

29. The process of claim 28 further comprising initiating crosslinking of said polymer melt with said chemical initiator by increasing the temperature of said polymer melt above the onset of crosslinking temperature, and controlling the temperature of said polymer melt during said crosslinking.

30. The process of claim 28 further comprising the step of initiating crosslinking of said polymer melt with said chemical initiator by increasing the temperature of said polymer melt above the onset of crosslinking temperature and within 150° C. of the base resin melting temperature, and controlling the temperature of said polymer melt during said crosslinking.

31. The process of claim 24 further comprising the step of mixing a chemical initiator into said polymer melt at a temperature lower than the onset of crosslinking temperature, thereby producing good dispersion of the chemical initiator in said polymer melt prior to onset of crosslinking of said polymer melt.

32. The process of claim 24 comprising allowing said crosslinking reaction to be effected to completion.

33. The process of claim 24 wherein said reactive base resin is a linear unsaturated polyester resin.

34. The process of claim 33 wherein said linear unsaturated polyester resin is a poly(propoxylated bisphenol A fumarate).

35. The process of claim 24 wherein said melt mixing process is accomplished in an extruder.

36. A high gloss toner comprised of the resin of claim 1 and pigment.

37. A high gloss toner comprised of a low melt, high gloss toner resin consisting essentially of uncrosslinked portions and crosslinked portions, said crosslinked portions consisting essentially of high density crosslinked microgel particles, wherein said microgel particles have a gel content of from 2 to 9 weight percent and pigment, and said resin is substantially free of sol.

38. A developer composition comprised of the toner of claim 15 and carrier particles.

39. The toner in accordance with claim 15 further containing a wax with a weight average molecular weight of from about 1,000 to about 20,000, or mixtures of waxes.

40. The toner in accordance with claim 15 further containing a charge enhancing additive.

* * * * *